US005678942A

United States Patent [19]

Kobayashi et al.

[11] Patent Number: 5,678,942

[45] Date of Patent: Oct. 21, 1997

[54] BALL-POINT PEN

[75] Inventors: Seiichi Kobayashi; Kazuaki Matsumoto, both of Yokohama; Toru Kitao, Sagamihara, all of Japan

[73] Assignee: Mitsubishi Pencil Kabushiki Kaisha, Tokyo, Japan

[21] Appl. No.: 601,246

[22] Filed: Feb. 14, 1996

[30] Foreign Application Priority Data

| | | | |
|---|---|---|---|
| Feb. 28, 1995 | [JP] | Japan | 7-063487 |
| Feb. 28, 1995 | [JP] | Japan | 7-063488 |
| Feb. 28, 1995 | [JP] | Japan | 7-063489 |
| Feb. 28, 1995 | [JP] | Japan | 7-063490 |
| Feb. 28, 1995 | [JP] | Japan | 7-063491 |

[51] Int. Cl.[6] ..... B43K 7/10

[52] U.S. Cl. ..... 401/219; 401/214; 401/205; 401/209

[58] Field of Search ..... 401/209, 214, 401/219, 220, 205, 232, 216, 274

[56] References Cited

U.S. PATENT DOCUMENTS

| | | | |
|---|---|---|---|
| 2,969,041 | 1/1961 | Arango | 401/209 X |
| 4,311,403 | 1/1982 | Liguori | 401/209 |
| 4,786,198 | 11/1988 | Zgambo | 401/142 |
| 5,277,510 | 1/1994 | Okamoto et al. | 401/214 |

FOREIGN PATENT DOCUMENTS

| | | | |
|---|---|---|---|
| 4-52067 | 12/1992 | Japan . | |
| 406171290 | 6/1994 | Japan | 401/219 |

*Primary Examiner*—Danton D. DeMille
*Attorney, Agent, or Firm*—Darby & Darby

[57] ABSTRACT

A ball-point pen having a coupling, a tip at the distal end of the coupling, and a reservoir tube at the proximal end of the coupling. The tip may held in a tip holder, which, in turn, is coupled to the distal end of the coupling. A valve chamber is formed within the coupling with a ball seat having a guide hole therethrough on the rear portion of the valve chamber and projecting ridges on the front portion of the valve chamber. When the ball-point pen is positioned with its tip upward, a ball valve is brought into contact with the ball seat to close the guide hole and thereby prevent back flow of ink. When the ball-point pen is positioned with its tip downward, the guide hole is opened and the ball valve contacts the rear ends of the projecting ridges, so that ink flows into the tip through the guide hole, the valve chamber, and grooves formed between the ridges. A spring may be interposed in the inner hole of the tip with its proximal end held in place by the coupling. The distal end of the spring presses a writing point ball into contact with the ball-holding portion of the tip. A low-viscosity ink or an ink having shear thinning properties, i.e., statically a high viscosity which is decreased upon rotation of the ball during writing, is preferably used.

13 Claims, 15 Drawing Sheets

BALL-POINT PEN

BACKGROUND OF THE INVENTION (1) Field of the Invention

The present invention relates to an improvement in a ball-point pen using a low-viscosity ink or an ink having so-called shear thinning properties, i.e., an ink which has basically a low viscosity but statically a high viscosity, which is decreased upon rotation of a ball during writing so that the ink flows out.

(2) Description of the Prior Art

A ball-point pen is known which uses an ink having shear thinning properties, the viscosity of which is decreased upon rotation of a writing point ball during writing so that the ink flows out. Generally, a ball-point pen using an ink having shear thinning properties has a large amount of ink outflow, and therefore (in order to increase the writing density) the content of the ink is increased by means of increasing the diameter of the reservoir tube. As the viscosity of this ink is lower than that of an oil-based ball-point pen, this ink has a small flow resistance against the reservoir tube. Accordingly, ink leakage (in which the ink flows backward to the rear end of the reservoir tube) tends to occur due to the weight of the ink or upon application of an impact. For this reason, a grease-like follower is usually provided at the rear end of the ink. This follower moves following the exhaustion of the ink during writing and suppresses the back flow of the ink caused by the weight of the ink or an impact. However, even if a follower is provided, when the ball-point pen is subjected to writing in an upright position, and the ink immediately under the ball of the tip is exhausted, the pressure head of the ink acts directly to cause a conspicuous back flow to soil the user's hand or cloths. As the ink has a low viscosity and a large outflow amount, if a gap is formed between the writing point ball and the tip-caulking portion when the ball-point pen is used in a downward position, the ink runs from the tip (forward flow).

In Japanese Utility Model Publication Hei 4 No.52067, the present inventors disclose a back-flow preventing mechanism for an ink of a ball-point pen provided with a valve chamber in which a ball is loosely fitted. In this ball-point pen, a required number of projecting ridges for disabling the ball to fall off are formed in a valve chamber in which the ball is loosely fitted. During writing, the ink flows to the tip through gaps formed between the projecting ridges.

SUMMARY OF THE INVENTION

The present invention aims at an improvement in a ball-point pen using a low-viscosity ink or an ink having so-called shear thinning properties, i.e., an ink which has basically a low viscosity but statically a high viscosity which is decreased upon rotation of a ball during writing so that the ink flows out, and one of its objects is provide a ball-point pen in which the back flow of the ink caused by writing in upright position or an impact is prevented, so that contamination of the interior of the barrel of the ball-point pen or the user's hand or cloths can be prevented, and furthermore scratchy writing immediately after application of an impact can be prevented.

It is another object of the present invention to satisfy the above object for a fine-pointed ball-point pen whose writing point ball has a diameter of 0.3 or 0.4 mm.

In order to achieve the above objects, according to the present invention, there is provided a ball-point pen having a tip at a distal end of a coupling and an ink reservoir tube behind the coupling, characterized in that a holder in which the longitudinal outer surface of the tip is fitted is mounted at the distal end of the coupling, a pipe-shaped small-diameter tip is mounted tightly on the holder, a valve chamber is formed at an axial center in a rear portion of the coupling, a tapered or spherical ball seat is formed on a rear portion of the valve chamber, a required number of projecting ridges are formed on a front portion of the valve chamber, a ball valve that can be brought into tight contact with the ball seat is loosely fitted in the valve chamber, when the ball-point pen is set with a tip thereof being directed upward, the ball valve is brought into tight contact with the ball seat to hermetically close a guide hole, and when the ball-point pen is set with the tip thereof being directed downward, a hermetic state of the guide hole is canceled, and the ball valve is brought into contact with rear ends of the projecting ridges, so that an ink flows into the tip through the guide hole, the valve chamber, grooves formed between the projecting ridges.

DETAILED DESCRIPTION OF THE PREFERRED EMBODIMENTS

A ball-point pen according to the present invention will be described with reference to FIGS. 1, 2, and 10.

Figure 1:
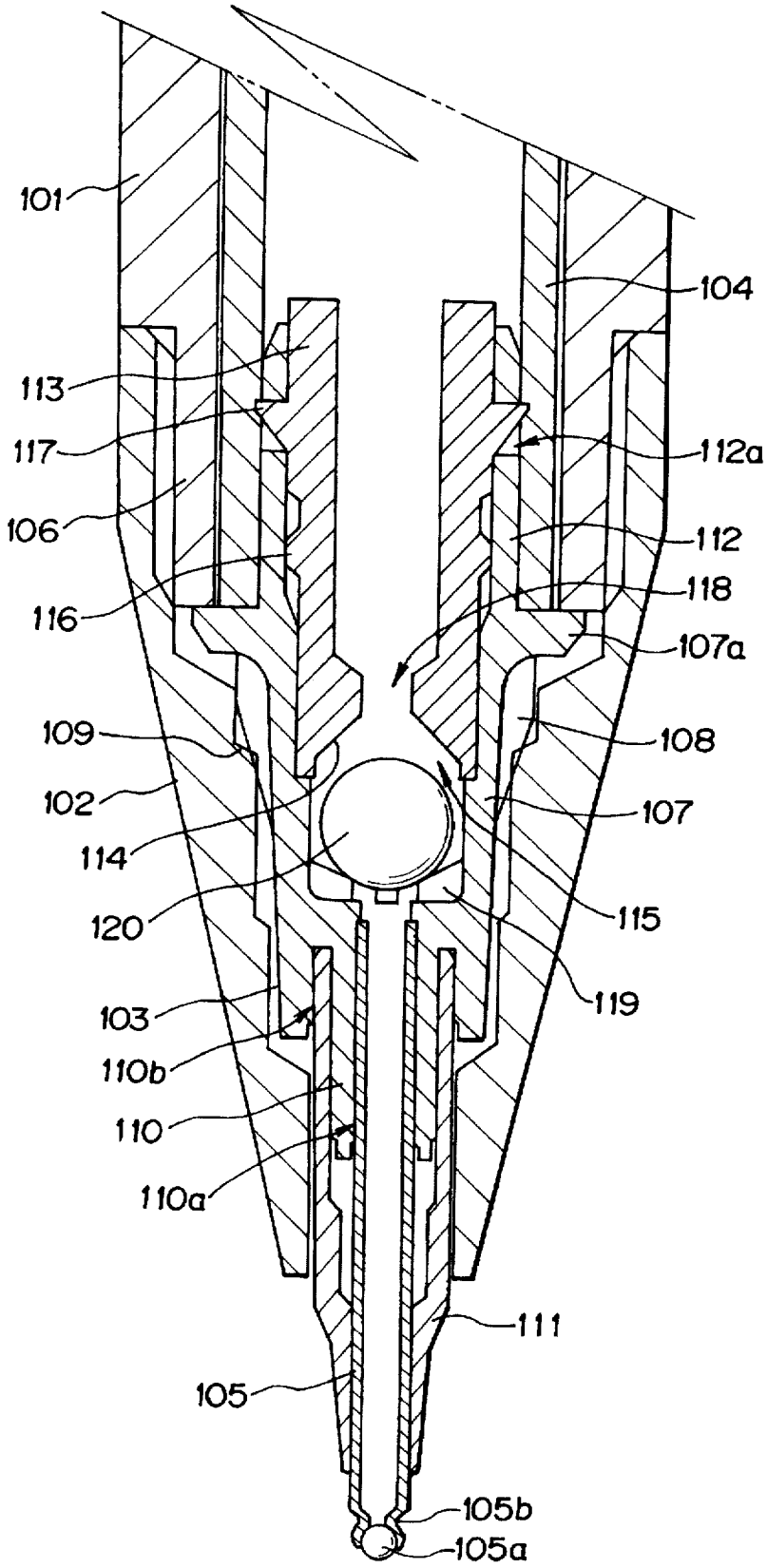
FIG. 1 is a longitudinal sectional view of the main part of a ball-point pen according to Example 1 of the present invention, which is set with its tip being directed downward.
Figure 2:
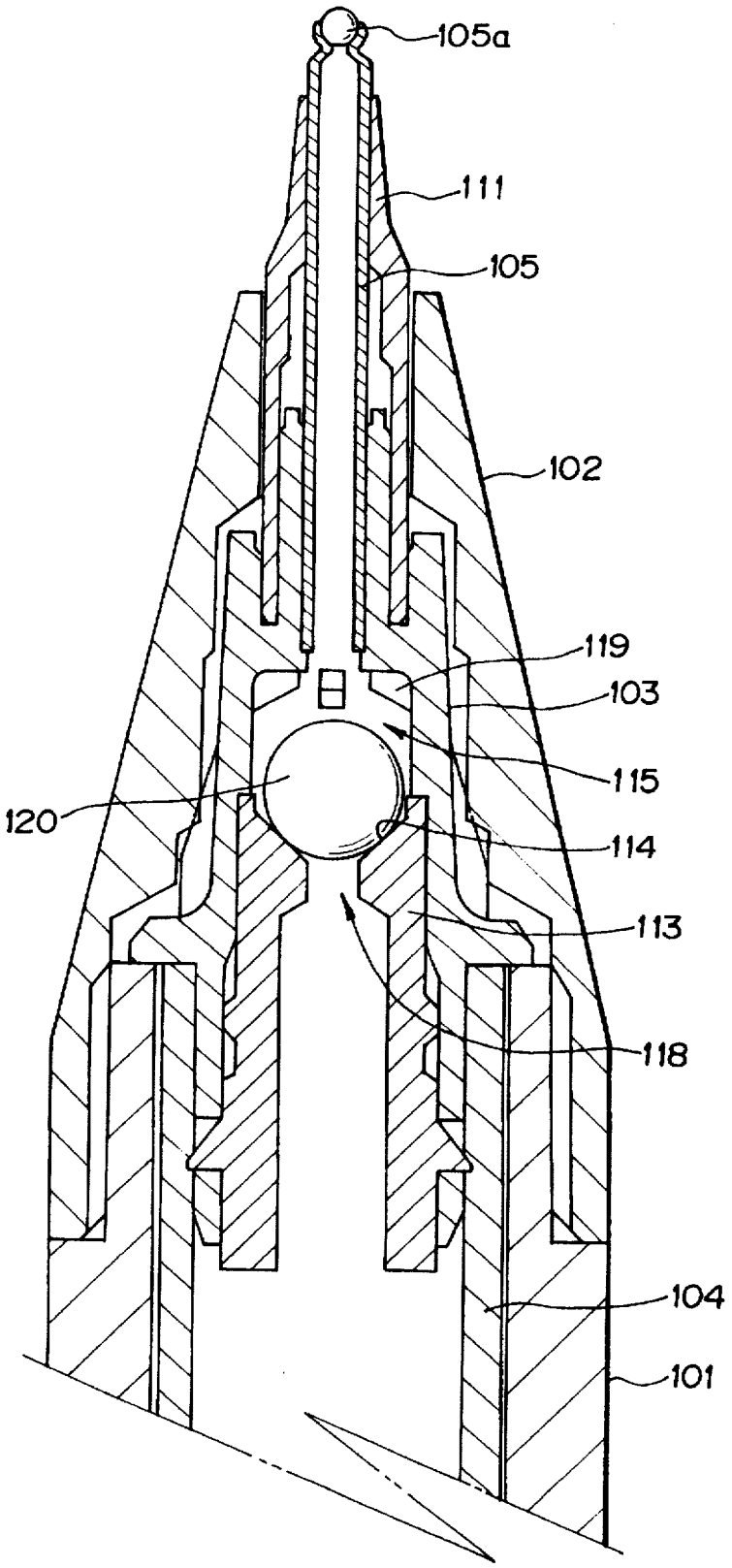
FIG. 2 is a longitudinal sectional view of the main part of the ball-point pen according to Example 1, which is set with its tip being directed upward.
Figure 3:
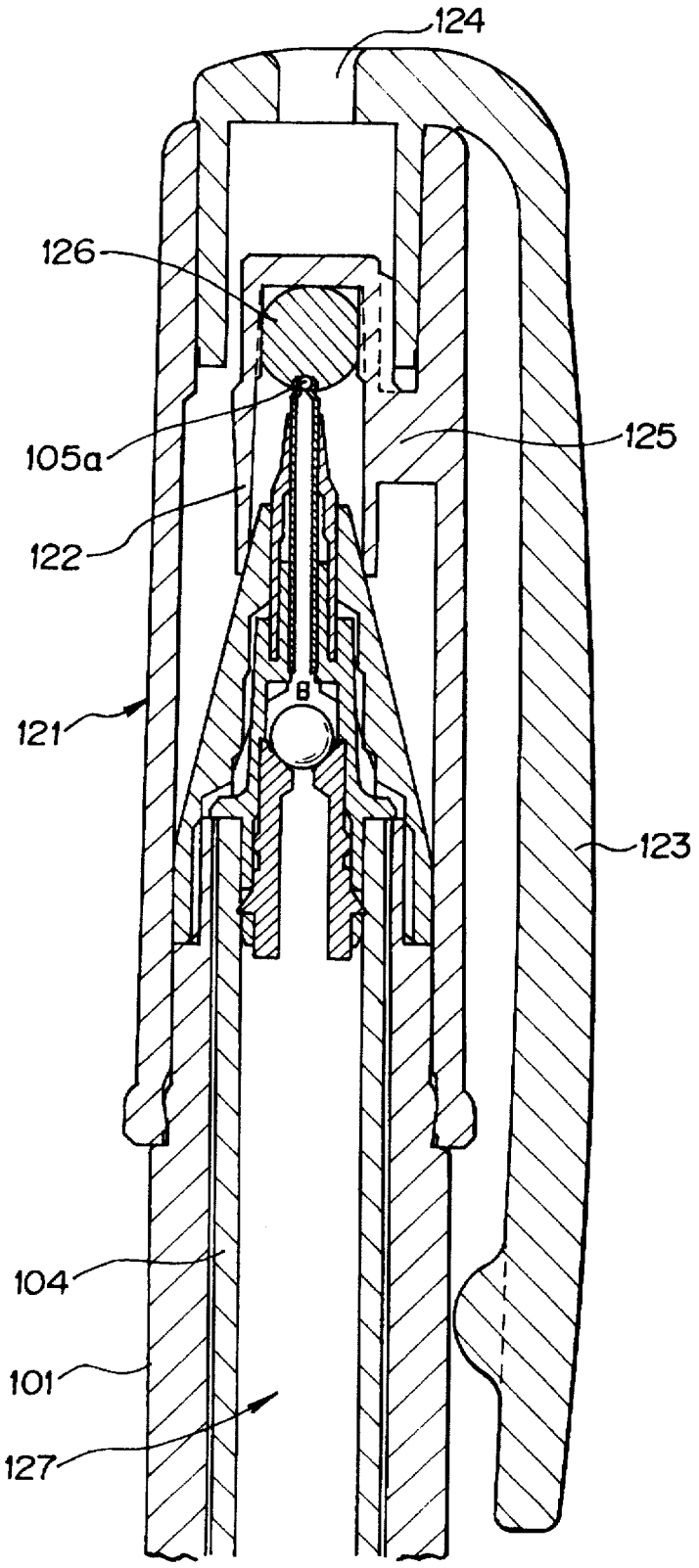
FIG. 3 is a longitudinal sectional view showing the front half of the entire portion of the ball-point pen according to Example 1.
Figure 4:
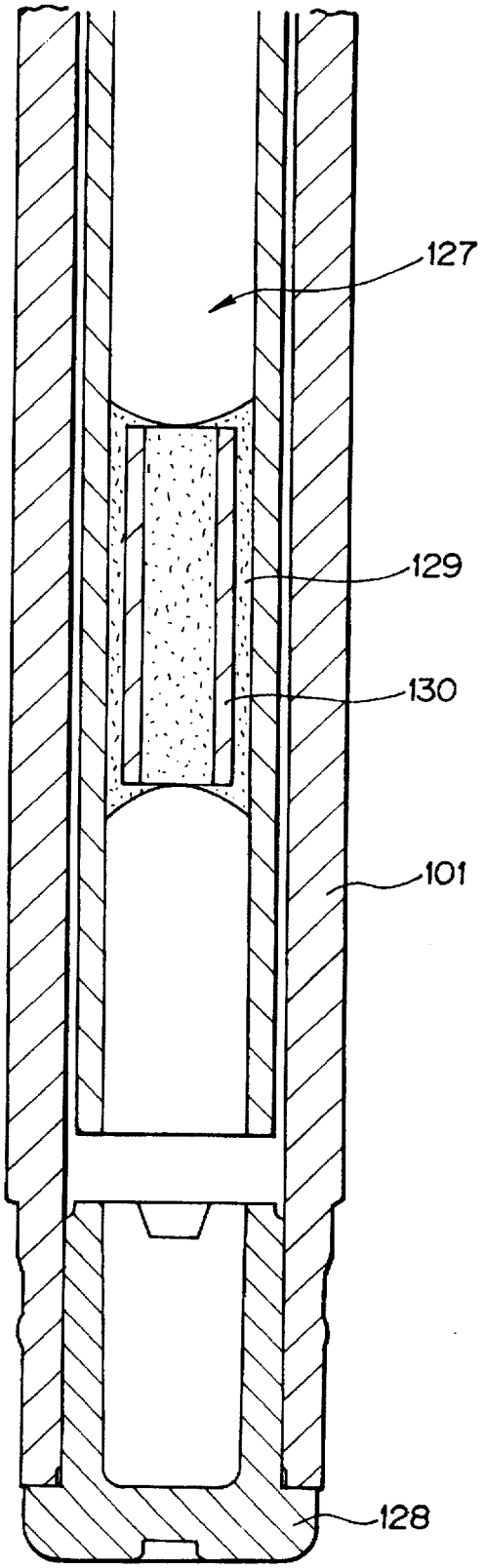
FIG. 4 is a longitudinal sectional view showing the rear half of the entire portion of the ball-point pen according to Example 1.

Referring to FIGS. 1 and 2, the refill of a ball-point pen, which is obtained by fixing a tip 105 and a reservoir tube 104 filled with an ink to a coupling 103, is inserted in a barrel 101. The rear edge of a flange portion 107*a* of the coupling 103 is abutted against to the front surface of a shaft portion 106 of the barrel 101. A mouthpiece 102 having a stepped portion 109 on its inner surface portion is threadably mounted on the shaft portion 106 of the barrel 101 such that its stepped portion 109 is abutted against the outer surface of a rib 108 of the coupling 103. A tail plug 128 is fixedly mounted at the rear end of the barrel 101. The ball-point pen is thus consistituted.

The tip 105 is a thin pipe made of stainless steel or the like. The tip 105 is caulked with a pressure at its three outer surface portions so as to rotatably hold a writing point ball 105*a* in substantially contacting with a seat 105*b* having channels through which the ink can flow.

The inner portion of the reservoir tube 104 leads to a guide hole 118 of the coupling 103. A low-viscosity ink or an ink 127 having shear thinning properties, i.e., an ink which has basically a low viscosity but statically a high viscosity, which is decreased upon rotation of the ball during writing so that the ink can flow out, is filled in the reservoir tube 104. A grease-like follower 129 is filled at the rear end of the ink 127. As the ink is consumed, the follower 129 can move with being in contact with the ink surface. A follower rod 130 made of a resin and having a specific gravity nearly equal to that of the follower 129 is immersed in the follower 129. The follower rod 130 is provided as required (when the diameter of the section of the ink-reservoir portion is large and thus the weight of the ink is large, or when the ink has a low viscosity and the head pressure of the ink cannot be resisted). The follower rod 130 is formed into a rod having a round or odd-shaped section, a cylinder, a cup, or the like as required.

FIG. 1 shows the ball-point pen before writing with its tip 105 being directed downward. At this time, a ball valve 120 is in contact with the rear ends of projecting ridges 119, and the guide hole 118 is open. The ink 127 entering from the reservoir tube 104 into a valve chamber 115 through the guide hole 118 is guided to the rear surface of the writing point ball 105*a* through grooves formed between the projecting ridges 119.

FIG. 2 shows the ball-point pen with its tip 105 being directed upward. At this time, the ball valve 120 is in tight contact with a ball seat 114 of the valve chamber 115, thereby hermetically closing the guide hole 118. Thus, even if the ink immediately under the tip 105 is exhausted by upward writing, the ink 127 does not flow backward. Accordingly, the ink 127 can flow out immediately after the ball-point pen is set with its tip 105 being directed downward, so that scratching is prevented through writing. In a ball-point pen not having a ball valve, even if the ink does not flow backward immediately after set the pen upward, the ink causes action in the backward direction, so that air is caught in the tip. Then, the ink cannot catch up with downward writing immediately, and scratching occurs.

Figure 10:
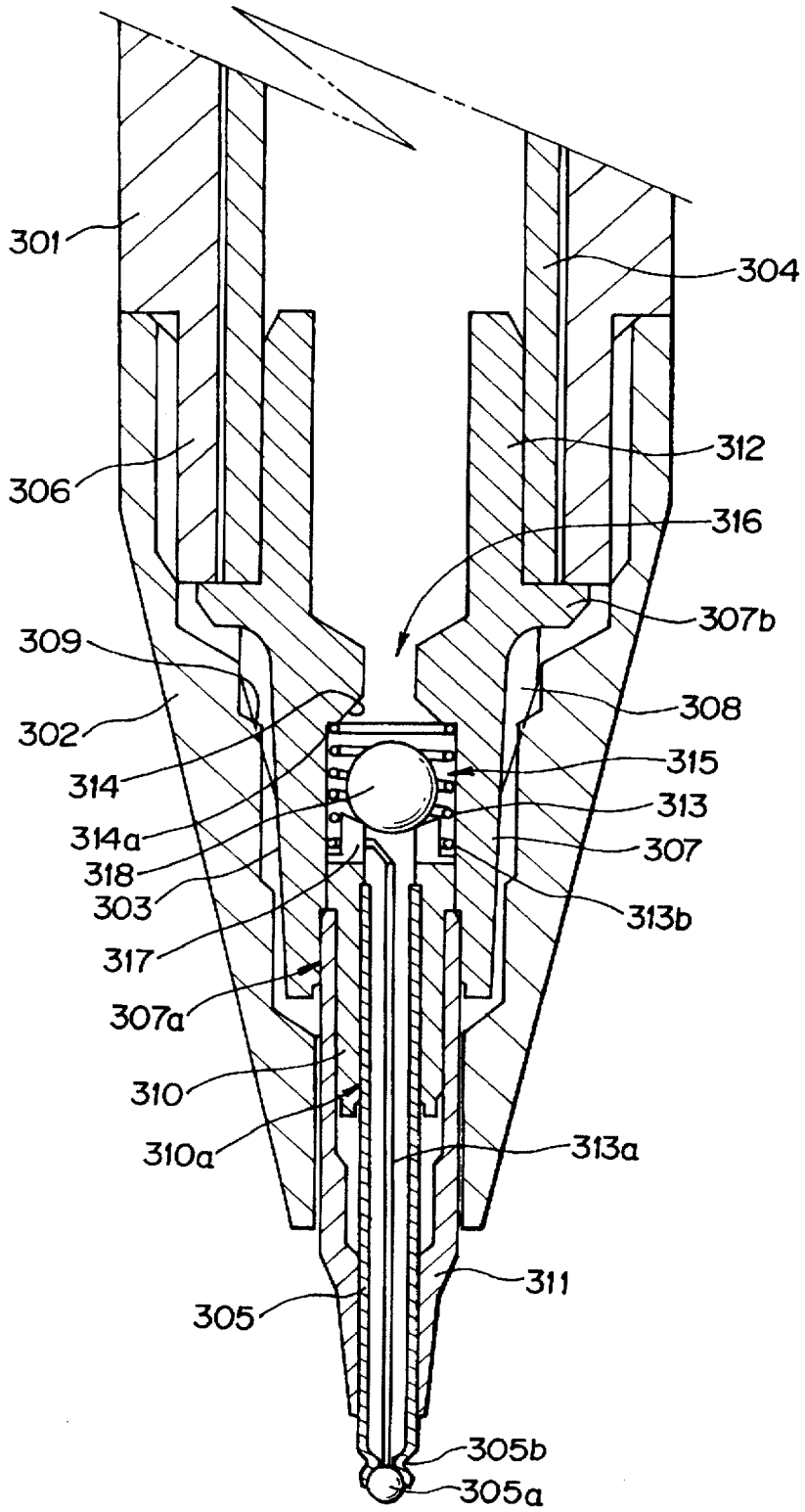
FIG. 10 is a longitudinal sectional view of the main part of a ball-point pen according to Example 6, which is set with its tip being directed downward.

In FIG. 10, a spring 313 is interposed in the hole of a tip 305 such that its rear end portion is in contact with a stepped portion 314*a* in the rear portion of a valve chamber 315. The distal end of the spring 313 presses the rear surface of a writing point ball 305*a* rotatably held at the distal end portion of the tip 305, and the writing point ball 305*a* is brought into tight contact with the inner edge of the ball holding portion of the tip 305.

Prevention of flowing out and back flow of the ink is achieved by pressing the writing point ball 305*a* with the spring 313. This compensates for the incomplete tight contact of the writing point ball 305*a* and the ball holding portion caused by variations in machining of the ball holding portion, or the incomplete tight contact caused when a solid substance attaches in a gap between the ball holding portion and the writing point ball 305*a*, and serves to resist the large head pressure of the ink, so that the back flow of the ink is reliably prevented and catching of air is moderated (scratching is prevented).

EXAMPLES

The present invention will be described in detail by way of examples thereof.

Example 1

FIGS. 1 to 5 show Example 1 of the present invention. As shown in FIGS. 1 to 5, a cylindrical locking portion 107 and a cylindrical fitting portion 112 are provided at the front and rear halves of the coupling 103 respectively, and a rib 108 inclined forward in the axial direction is provided at a required position on the circumference of the cylindrical locking portion 107. An inner shaft portion 110 having a tip fitting hole 110*a* in its center portion is formed at the front end of the cylindrical locking portion 107, and a holder fitting hole 110*b* is formed around the inner shaft portion 110. The tip 105 is pressed into the tip fitting hole 110*a* from the rear end side. A holder 111 is mounted tightly on the inner shaft portion 110 such that it holds the tip 105, and the holder 111 is pressed into the holder fitting hole 110*b*. Window portions 112*a* are formed in the cylindrical fitting portion 112.

The coupling 103 is integrally molded from an elastically deformable synthetic resin, and a large-diameter hole portion is formed in the rear portion of the coupling 103 to lead to the tip fitting hole 110*a*. The projecting ridges 119 are formed on the inner surface of the front end of the hole portion.

A bushing 113 has the tapered or spherical ball seat 114 at its axial center, and the guide hole 118 is formed in the bushing 113 to extend from the center of the ball seat 114 to the rear end.

A space in front of the ball seat 114 forms the valve chamber 115.

A projecting portion 116 is circumferentially formed on the outer surface of the bushing 113, and projecting ridge-like locking portions 117 are circumferentially formed on the rear portion of the bushing 113.

In this manner, the valve chamber 115 is shaped between the ball seat 114 and projecting ridges 119, and the ball valve 120 is loosely fitted in the valve chamber 115.

Figure 5:
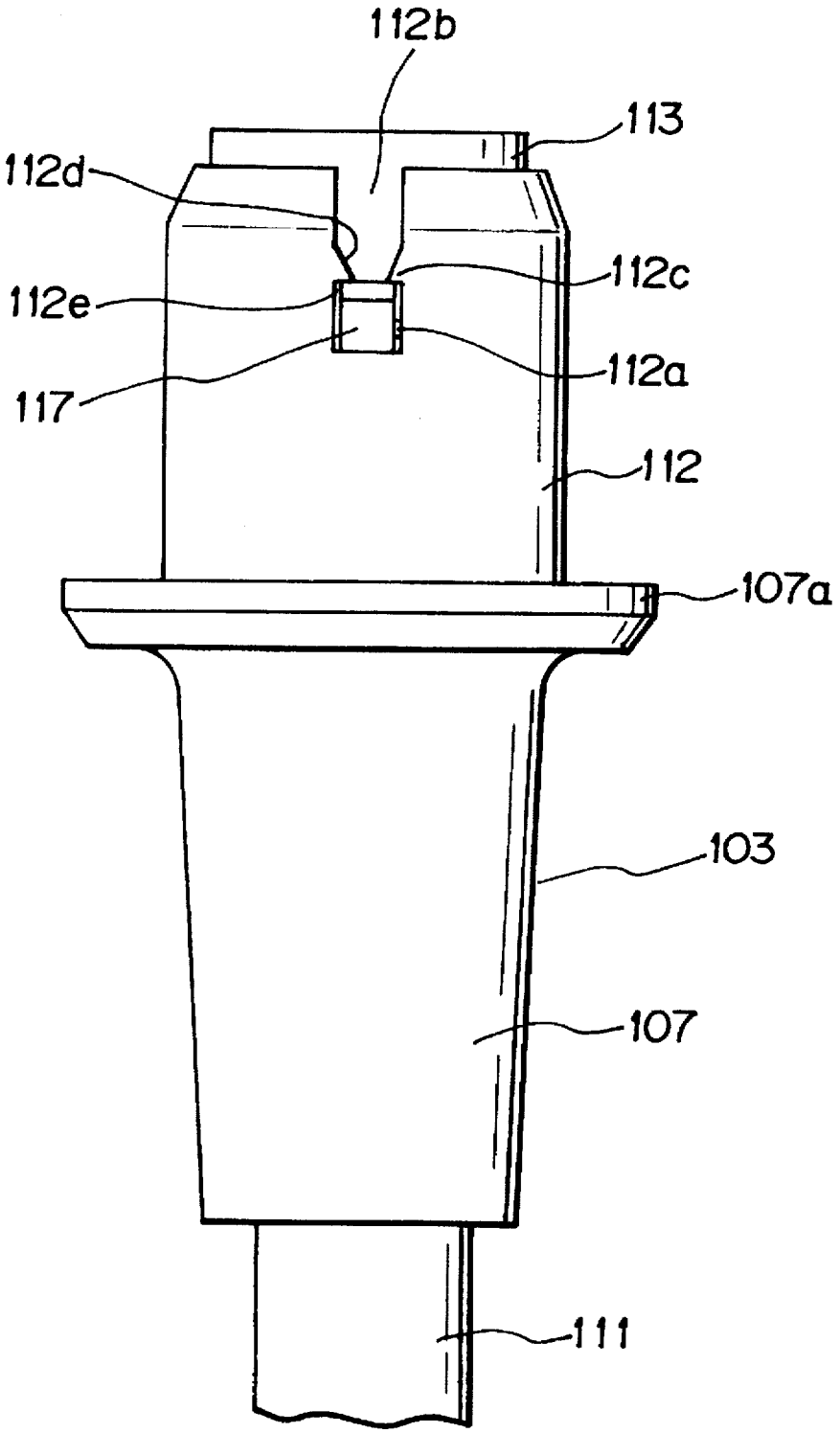
FIG. 5 is a plan view showing a coupling and a bush of Example 1 fixed to each other.

The bushing 113 is inserted into the coupling 103 from the rear end of the coupling 103, and the locking portions 117 are elastically engaged with the window portions 112*a*, so that the bushing 113 is positioned and fixed in the hole portion in the rear portion of the coupling 103 (see FIG. 5). At this time, the projecting portion 116 is brought into tight contact with the circumferential surface of the hole portion of the coupling. When the bushing 113 is fixed, it is fitted on the circumferential surface of the hole portion of the coupling 103. Thus, the ball valve 120 is reliably prevented from being removed from the chamber 115.

With the above arrangement, when the ball-point pen is set with its tip being directed downward, the ball valve 120 is brought into contact with the rear ends of the projecting ridges 119, and the ink 127 enters the inner hole of the tip 105 through the guide hole 118, the valve chamber 115, the grooves between the projecting ridges 119, and reaches the rear surface of the writing point ball 105*a*.

The flange portion 107*a* is provided at the rear end of the cylindrical locking portion 107 of the coupling 103, and the cylindrical fitting portion 112 extends backward from the flange portion 107*a*. The cylindrical reservoir tube 104 is pressed onto and fixed on the outer surface of the cylindrical fitting portion 112 such that its distal end is in contact with the rear end of the flange portion 107*a*. Since the locking portions 117 of the bushing 113 are formed to slightly project from the outer surface of the cylindrical fitting portion 112, they bite into the inner wall of the reservoir tube 104, thereby firmly connecting the coupling 103 and the reservoir tube 104 with each other.

Example 2

Figure 6:
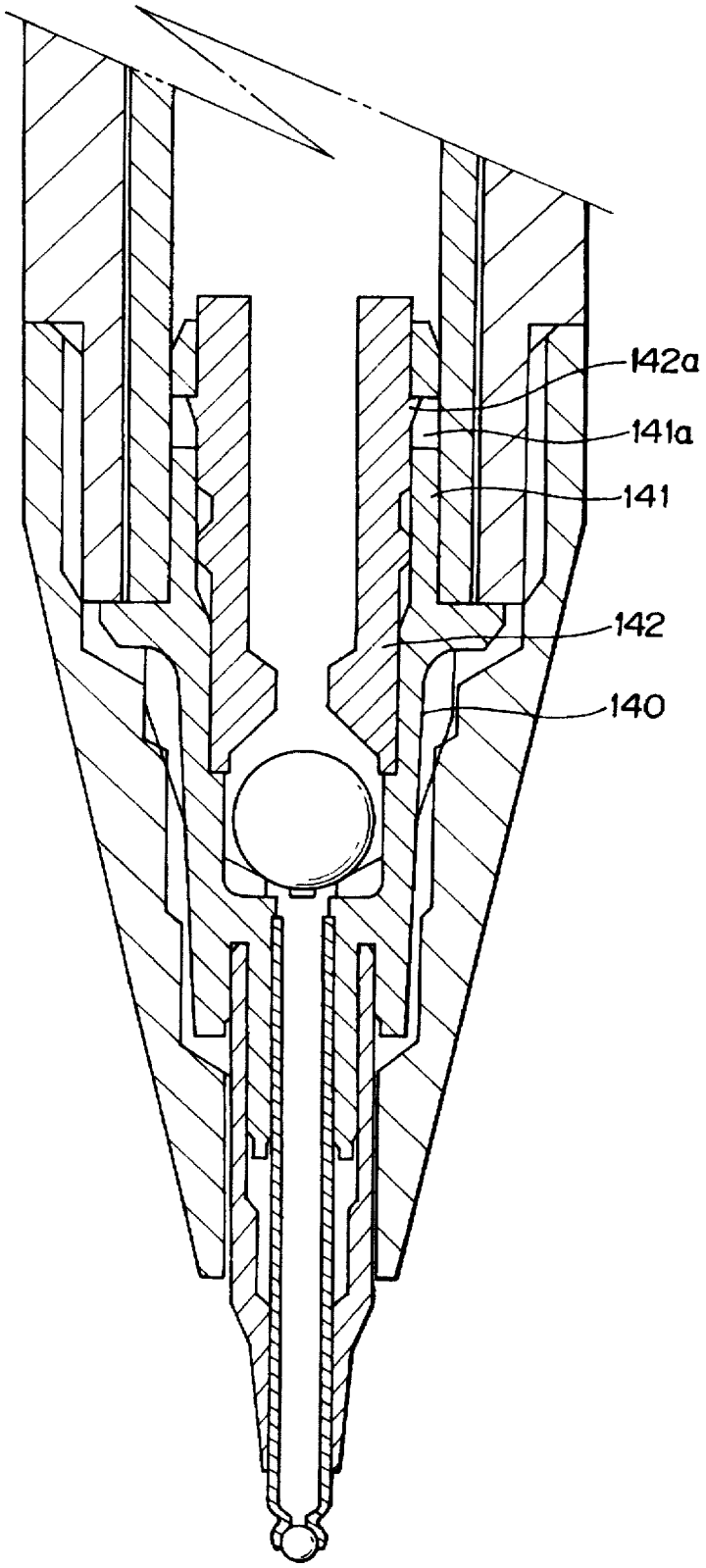
FIG. 6 is a longitudinal sectional view of the main part of a ball-point pen according to Example 2, which is set with its tip being directed downward.

FIG. 6 shows Example 2 of the present invention. Example 2 is basically the same as Example 1, and only different portion from Example 1 will thus be described. In Example 2, window portions 141*a* are formed in a cylindrical fitting portion 141 of a coupling 140, and small projections 142*a* formed on the outer surface of a bushing 142 are elastically engaged with the window portions 141*a*. Therefore, notched windows 112*b* need not be formed in the cylindrical fitting portion 112, unlike in Example 1 (FIG. 5).

Example 3

Figure 7:
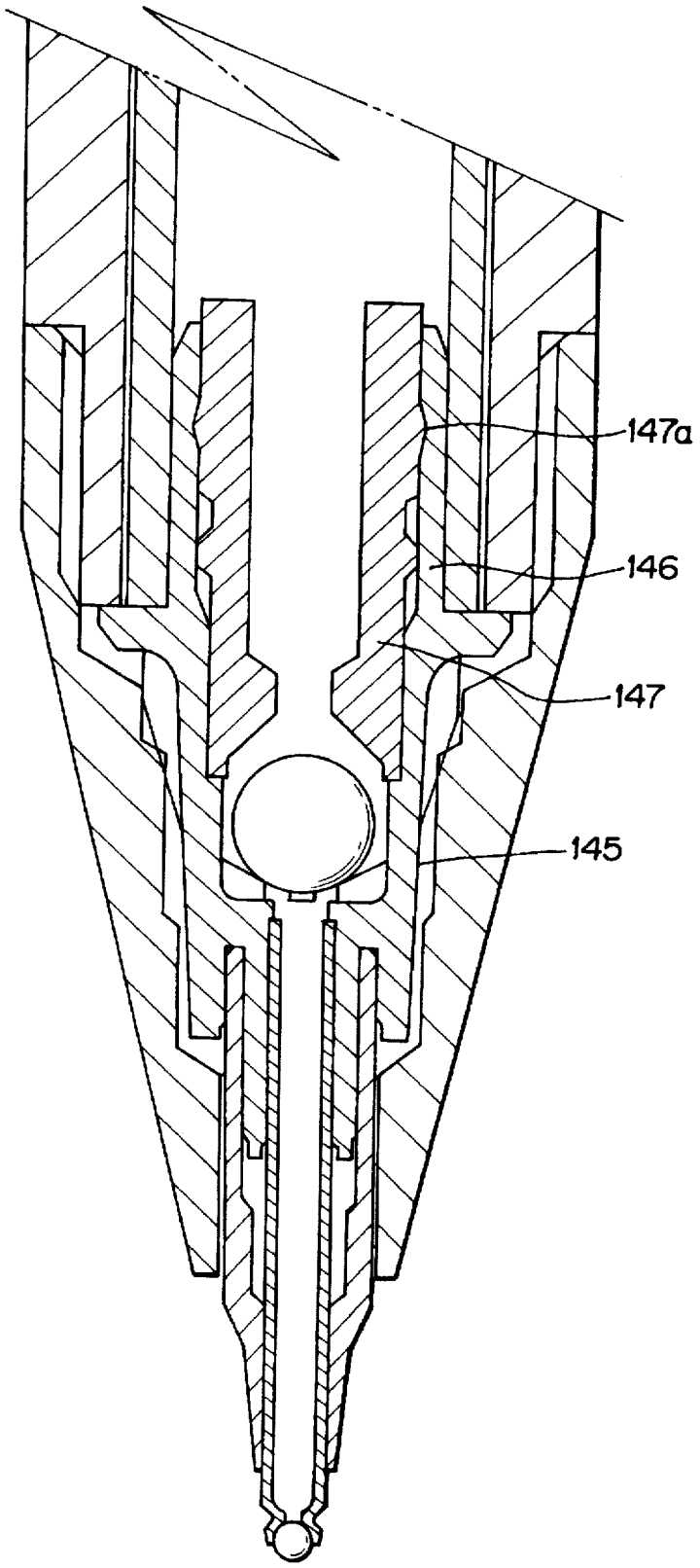
FIG. 7 is a longitudinal sectional view of the main part of a ball-point pen according to Example 3, which is set with its tip being directed downward.

FIG. 7 shows Example 3 of the present invention. Example 3 is basically the same as Example 1. In Example 3, a circumferential hill-shaped projecting portion 147*a* formed on the outer surface of a bushing 147 is mounted tightly to bite into the wall of the inner hole of a cylindrical fitting portion 146 of a coupling 145.

Example 4

Figure 8:
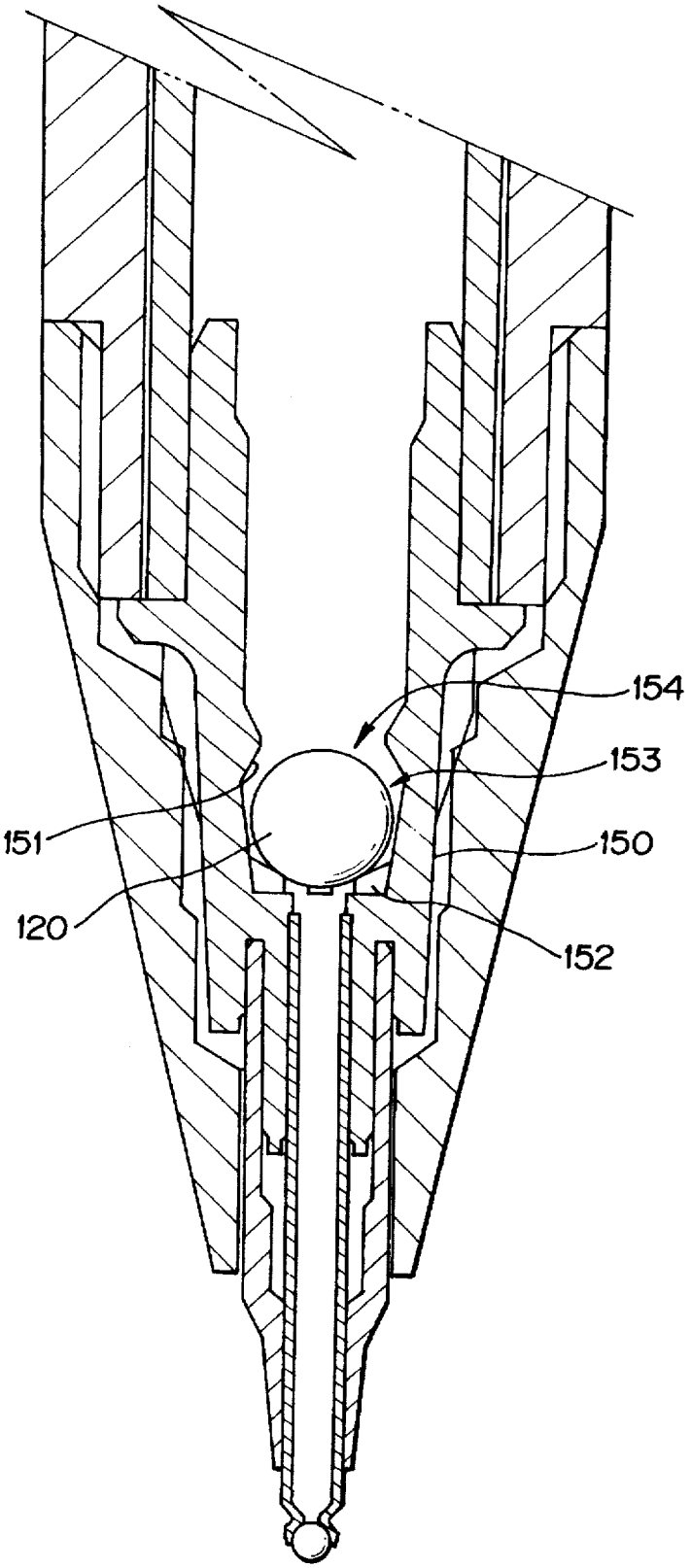
FIG. 8 is a longitudinal sectional view of the main part of a ball-point pen according to Example 4, which is set with its tip being directed downward.

FIG. 8 shows Example 4 of the present invention. In this example, a valve chamber 153 is formed at the axial center of a coupling 150, a circumferential projecting ridge-shaped ball seat 151 is formed at the rear end of the valve chamber 153, and a ball valve 120 is loosely fitted in the valve chamber 153 by elastically deforming the ball seat 151. In this case, even if a lubricating means is provided to the ball valve 120 or ball seat 151, the ball seat 151 is sometimes deformed or damaged slightly upon insertion of the ball valve 120.

Example 5

Figure 9:
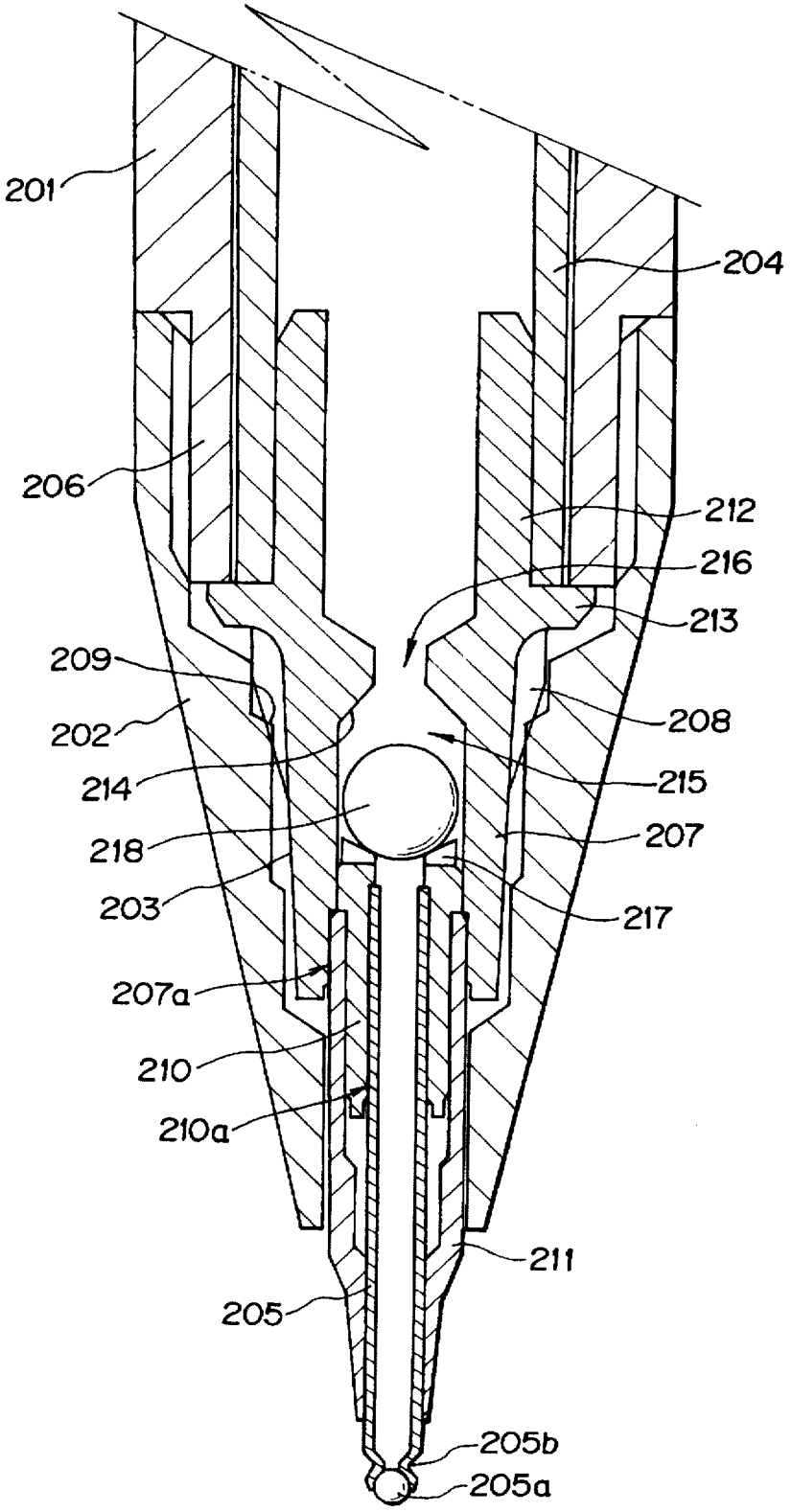
FIG. 9 is a longitudinal sectional view of the main part of a ball-point pen according to Example 5, which is set with its tip being directed downward.

FIG. 9 shows Example 5 of the present invention. As shown in FIG. 9, a cylindrical locking portion 207 and a cylindrical fitting portion 212 are provided at the front and rear halves of a coupling 203 respectively, and a rib 208 inclined forward in the axial direction is provided at a required position on the circumference of the cylindrical locking portion 207. A holder fitting hole 207*a* is formed at the center portion of the cylindrical locking portion 207 extending from the front end. An inner shaft portion 210 has a tip fitting hole 210*a* at its center portion extending from its front end, and a required number of ribs 217 are formed on the rear end of the inner shaft portion 210. After the rear portion of a tip 205 is pressed into the tip fitting hole 210*a* of the inner shaft portion 210, the tip 205 is inserted in the inner hole of a holder 211, and the inner shaft portion 210 is fixed to the rear side of the inner hole of the holder 211. In this state, the holder 211 is fixed to the holder fitting hole 207*a*.

The coupling 203 is integrally molded from an elastically deformable synthetic resin, and a valve chamber 215 is formed in the coupling 203 behind the holder fitting hole 207*a*.

A tapered or spherical ball seat 214 is formed at the rear end of the valve chamber 215, and a guide hole 216 is formed to extend from the center of the ball seat 214 to the rear end of the coupling.

The ribs 217 on the rear end of the inner shaft portion 210 are located at the front end of the valve chamber 215, and a ball valve 218 is loosely fitted in the valve chamber 215.

With the above arrangement, when the ball-point pen is set with its tip being directed downward, the ball valve 218 is brought into contact with the rear ends of the ribs 217, and the ink enters the inner hole of the tip 205 through the guide hole 216, the valve chamber 215, the grooves among the ribs 217, and reaches the rear surface of a writing point ball 205*a*.

A flange portion 213 is provided at the rear end of the cylindrical locking portion 207 of the coupling 203, and the cylindrical fitting portion 212 extends behind the flange portion 213. A cylindrical reservoir tube 204 is pressed and fixed onto the outer surface of the cylindrical fitting portion 212 such that its distal end is in contact with the flange portion 213.

Example 6

FIG. 10 shows Example 6 of the present invention. In this example, a spring is interposed in the inner hole of a tip extending from a valve chamber identical to that of Example 5.

A cylindrical locking portion 307 and a cylindrical fitting portion 312 are provided at the front and rear halves of a coupling 303 respectively, and a rib 308 inclined forward in the axial direction is provided at a required position on the circumference of the cylindrical locking portion 307. A holder fitting hole 307*a* is formed in the center portion of the cylindrical locking portion 307 extending from the front end. An inner shaft portion 310 has a tip fitting hole 310*a* at its center portion extending from its front end, and a required number of ribs 317 are formed on the rear end of the inner shaft portion 310. After the rear portion of a tip 305 is pressed into the tip fitting hole 310*a* of the inner shaft portion 310, the tip 305 is inserted in the inner hole of a holder 311, and the inner shaft portion 310 is fixed to the rear side of the inner hole of the holder 311.

A spring 313 consists of an upright straight portion 313*a* at its front side and a coil portion 313*b* at its rear side. The straight portion 313*a* is inserted in the inner hole of the tip 305, and the coil portion 313*b* is positioned around the ribs 317 at the rear end of the inner shaft portion 310.

The coupling 303 is integrally molded from an elastically deformable synthetic resin, and a valve chamber 315 is formed in the coupling 303 behind the holder fitting hole 307*a*.

A stepped portion 314*a* is formed on the rear portion of the valve chamber 315, a tapered or spherical ball seat 314 is formed at the rear end of the valve chamber 315, and a guide hole 316 is formed to extend from the center of the ball seat 314 to the rear end of the coupling. A ball valve 318 is inserted inside the coil portion 313b, and the holder 311 is fixed in the holder fitting hole 307a of the coupling 303.

At this time, the ribs 317 on the rear end of the inner shaft portion 310 are located at the front end of the valve chamber 315. The spring 313 extends forward while the rear end of its coil portion 313b is in contact with the stepped portion 314a behind the valve chamber 315, so that it forces the rear surface of the writing point ball 305a with the distal end of its straight portion 313a. The writing point ball 305a is brought into tight contact with the inner edge of the ball holding portion (formed by caulking or the like) of the tip 305 upon being forced by the distal end of the straight portion 313a of the spring 313. The ball valve 318 moves freely between the rear ends of the ribs 317 and the ball seat 314.

In a state other than writing, the writing point ball 305a is in tight contact with the inner edge of the tip holding portion. Thus, when the ball-point pen is set downward, flowing out of the ink and scratchy writing caused by dry-up can be prevented. During writing, the writing point ball 305a moves backward slightly by the writing pressure, so that the ink can flow out through the gap formed between the writing point ball 305a and the inner edge of the tip.

Example 7

Figure 11:
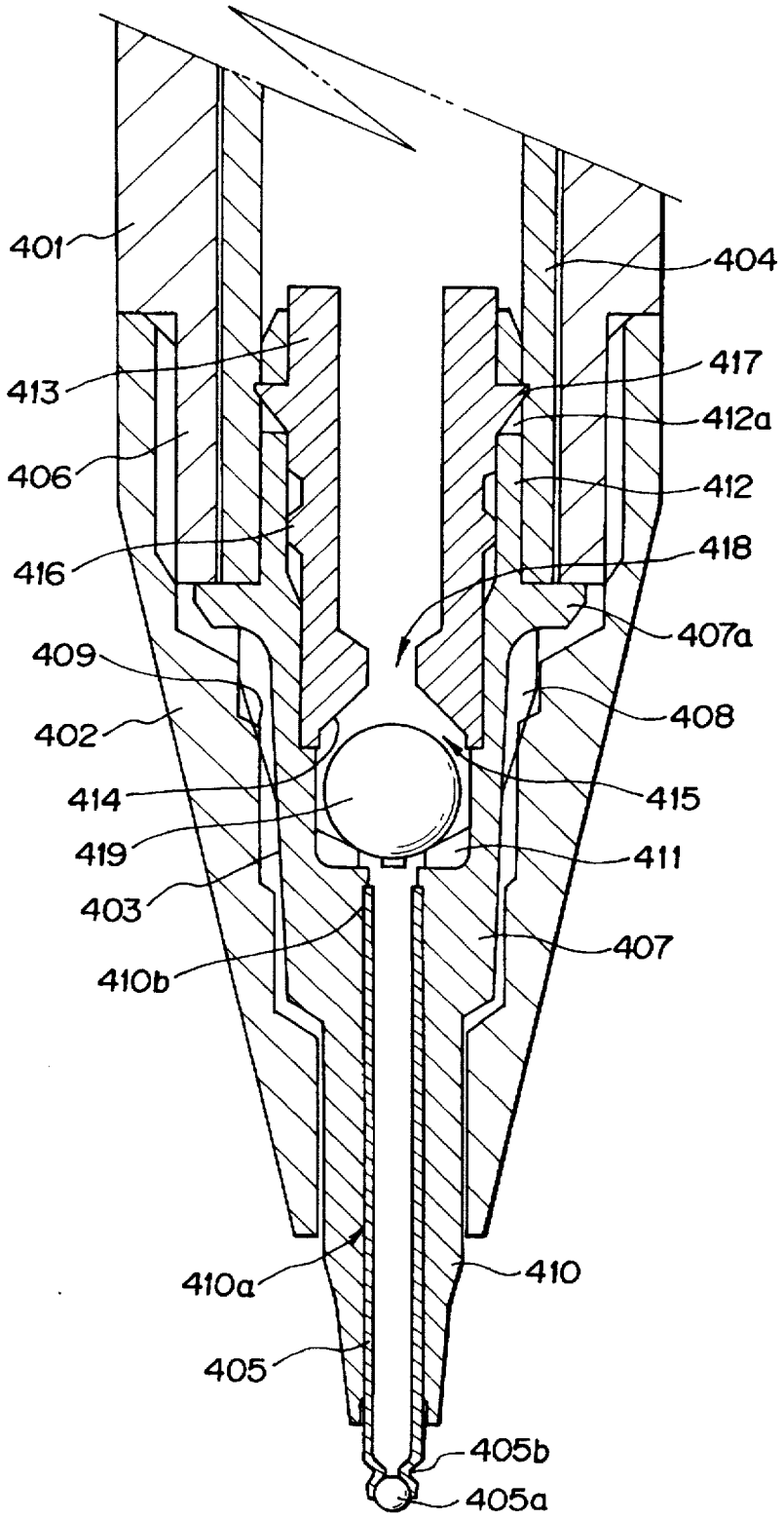
FIG. 11 is a longitudinal sectional view of the main part of a ball-point pen according to Example 7, which is set with its tip being directed downward.

FIG. 11 shows Example 7 of the present invention. As shown in FIG. 11, a cylindrical locking portion 407 and a cylindrical fitting portion 412 are provided at the front and rear halves of a coupling 403 respectively, and a holder portion 410 is formed in front portion of the cylindrical locking portion 407 to be integral with the coupling. A rib 408 inclined forward in the axial direction is provided at a required position on the circumference of the cylindrical locking portion 407. A tip fitting hole 410a is formed at its center portion extending from the distal end of the holder portion 410, and the rear portion of a tip 405 is pressed into the tip fitting hole 410a. Window portions 412a are formed at required portions of the side of the cylindrical fitting portion 412.

The coupling 403 is integrally molded from an elastically deformable synthetic resin, and a large-diameter hole portion is formed in the coupling 403 behind the tip fitting hole 410a. Projecting ridges 411 are formed on the front end of the hole portion.

A bushing 413 has a tapered or spherical ball seat 414 at its axial center, and a guide hole 418 is formed in the bushing 413 to extend from the center of the ball seat 414 to the rear end.

A projecting portion 416 is circumferentially formed on the outer surface of the bushing 413, and projecting ridge-like locking portions 417 are formed on the rear portion of the bushing 413.

The bushing 413 is inserted in the coupling 403 from the rear end of the coupling 403, and the locking portions 417 are elastically engaged with the window portions 412a of the cylindrical fitting portion 412, so that the bushing 413 is positioned and fixed in the hole portion in the rear portion of the coupling 403. At this time, the projecting portion 416 is brought into tight contact with the circumferential surface of the hole portion. In this manner, a valve chamber 415 is formed between the ball seat 414 and the projecting ridges 411. When the bushing 413 is fixed, a ball valve 419 is loosely fitted in the valve chamber 415.

A flange portion 407a is provided at the rear end of the cylindrical locking portion 407 of the coupling 403, and the cylindrical fitting portion 412 extends behind the flange portion 407a. A cylindrical reservoir tube 404 is pressed and fixed onto the outer surface of the cylindrical fitting portion 412 such that its distal end is in contact with the flange portion 407a. Since the locking portions 417 of the bushing 413 are formed to slightly project from the outer surface of the cylindrical fitting portion 412, they bite into the inner wall of the reservoir tube 404, thereby firmly connecting the coupling 403 and the reservoir tube 404 with each other.

Example 8

Figure 12:
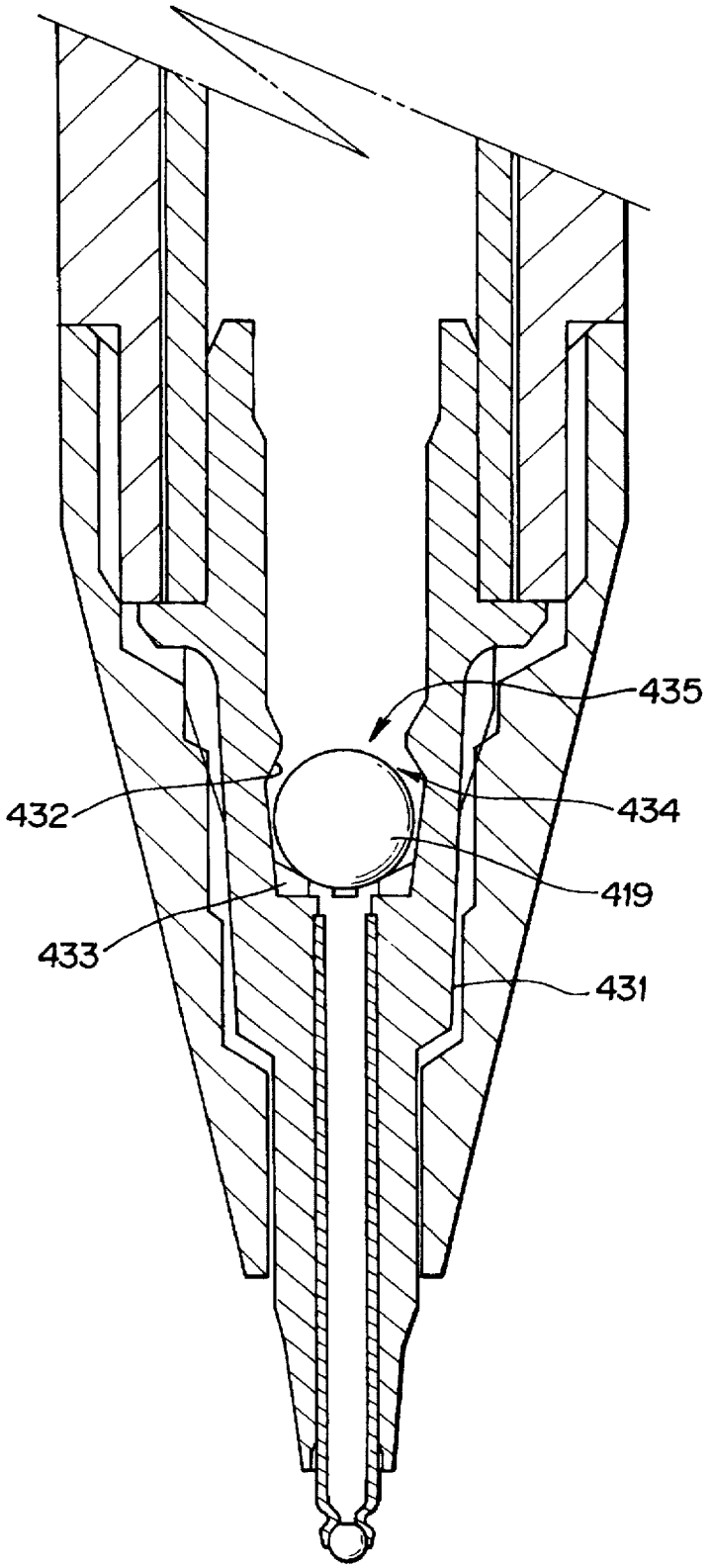
FIG. 12 is a longitudinal sectional view of the main part of a ball-point pen according to Example 8, which is set with its tip being directed downward.

FIG. 12 shows Example 8 of the present invention. In this example, a valve chamber 434 is formed at the axial center of a coupling 431, a circumferentially projecting ball seat 432 is formed at the rear end of the valve chamber 434, and a ball valve 419 is loosely fitted in the valve chamber 434 by elastic deformation of the ball seat 432. In this case, even if a lubricating means is provided to the ball valve 419 or ball seat 432, the ball seat 432 is sometimes deformed or damaged slightly upon insertion of the ball valve 419.

Example 9

Figure 13:
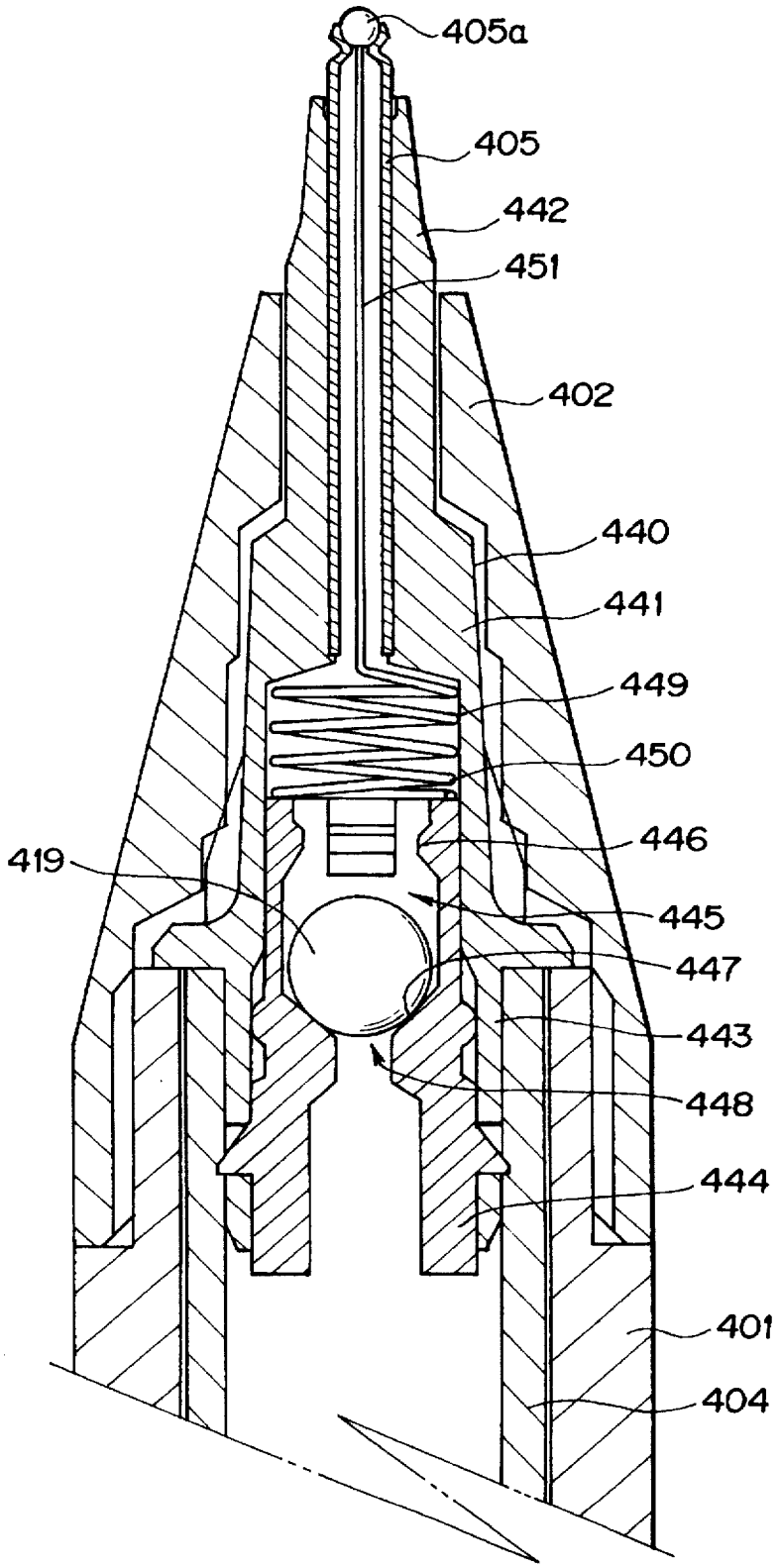
FIG. 13 is a longitudinal sectional view of the main part of a ball-point pen according to Example 9, which is set with its tip being directed upward.

FIG. 13 shows Example 9.

A coupling 440 of this example is also integrally molded from an elastically deformable synthetic resin, and a large-diameter hole portion is formed in the rear portion of the coupling 440 to lead to a tip fitting hole.

A bushing 444 has a tapered or spherical ball seat 447 at its axial center, and a guide hole 448 is formed in the bushing 444 to extend from the center of the ball seat 447 to the rear end. A space in front of the ball seat 447 forms a valve chamber 445, and a projecting ridge 446 is formed at the front portion of the valve chamber 445. A ball valve 419 is loosely fitted in the valve chamber 445 by elastically enlarging the projecting ridge 446.

In this case, even if a lubricating means is provided to the bushing 444 or the ball valve 419, the projecting ridge 446 is sometimes deformed or damaged slightly upon formation of the bushing 444 and insertion of the ball valve 419. However, as the ball valve 419 is elastically inserted in the valve chamber 445 before the bushing 444 is coupled with other members, once the bushing 444 is fixed to the coupling 440, the outer surface portion of the bushing 444 is restrained, so that the ball valve 419 is prevented from being removed. If the circumference of the shaft portion of the front portion of the bushing 444 is slotted at required portions to form a required number of elastic segments and projecting ridges are formed on the inner surfaces of the elastic segments, insertion of the ball valve into the valve chamber is facilitated.

A spring 449 consists of an upright straight portion 451 at its front portion and a coil portion 450 at its rear portion. The spring 449 is inserted in the hole portion of the coupling 440, and its straight portion 451 is inserted in the inner hole of a tip 405.

In this state, after the ball valve 419 is loosely fitted in the valve chamber 445, the bushing 444 is inserted in the coupling 440 from the rear end thereof and is fixed to it.

The rear end of the coil portion 450 of the spring 449 is brought into contact with the distal end of the bushing 444, and the distal end of the straight portion 451 is pressed against the rear surface of a writing point ball 405a.

By this pressure, the writing point ball 405a is brought into tight contact with the inner edge of the ball holding portion (formed by caulking or the like) of the tip 405.

Example 10

Figure 14:
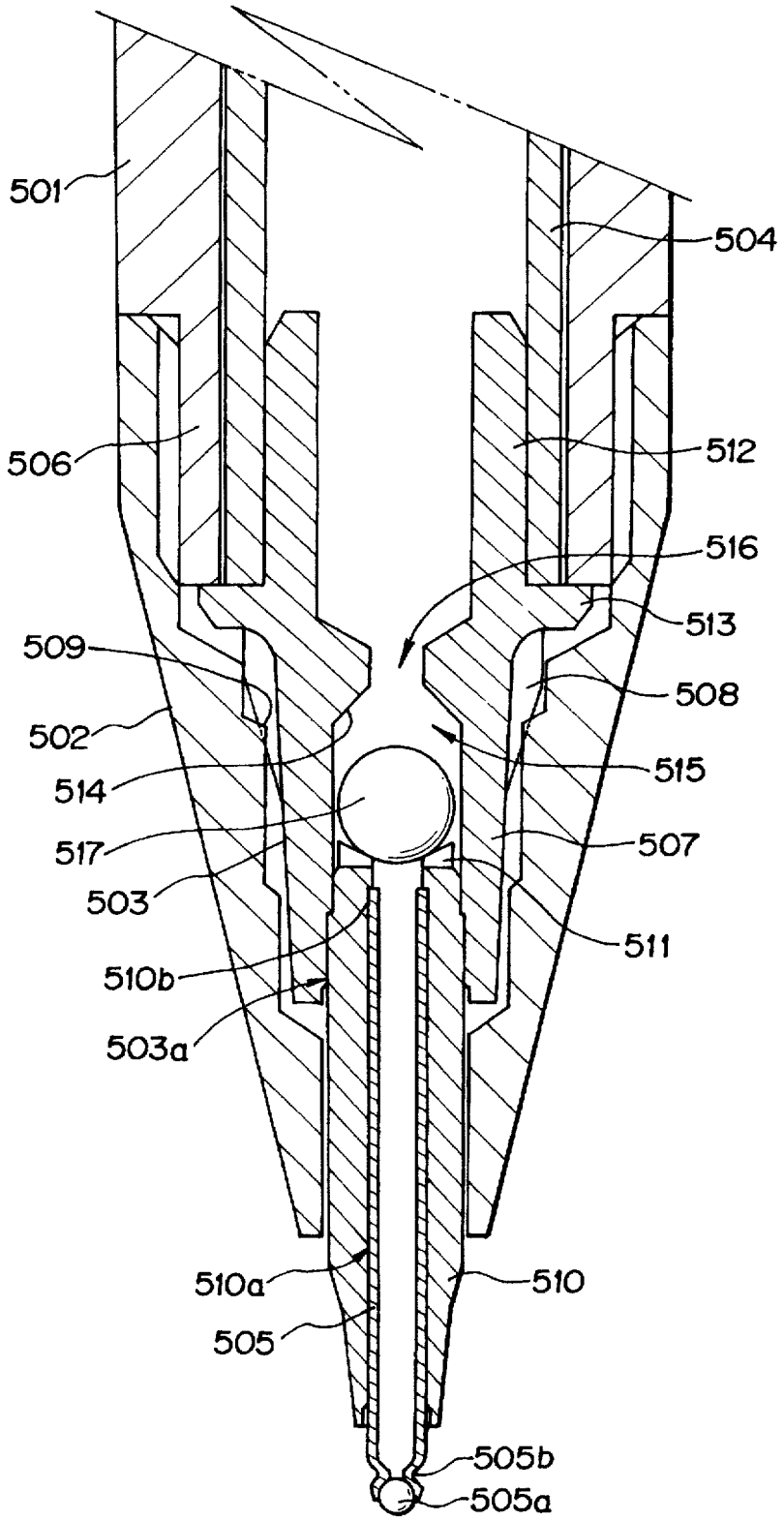
FIG. 14 is a longitudinal sectional view of the main part of a ball-point pen according to Example 10, which is set with its tip being directed downward.

FIG. 14 shows Example 10. In Example 10, a holder and an inner shaft portion identical to those of Example 5 are formed integrally.

A cylindrical locking portion 507 and a cylindrical fitting portion 512 are provided at the front and rear halves of a coupling 503 respectively, and a rib 508 inclined forward in the axial direction is formed at a required position on the circumference of the cylindrical locking portion 507. A holder fitting hole 503*a* is formed at the center portion of the cylindrical locking portion 507 extending from its front end. A holder 510 has a tip fitting hole 510*a* at its center portion extending from its front end, and a required number of ribs 511 are formed on the rear end of the holder 510. A tip 505 is inserted in the tip fitting hole 510*a* of the holder 510 from the rear side thereof and is fixed in the tip fitting hole 510*a*.

The coupling 503 is integrally formed of an elastically deformable synthetic resin, and a valve chamber 515 is formed in the rear portion of the coupling 503 to lead to the holder fitting hole 503*a*.

A tapered or spherical ball seat 514 is formed on the rear end of the valve chamber 515, and a guide hole 516 is formed to extend from the center of the ball seat 514 to the rear end.

A ball valve 517 is loosely fitted in the valve chamber 515.

Example 11

Figure 15:
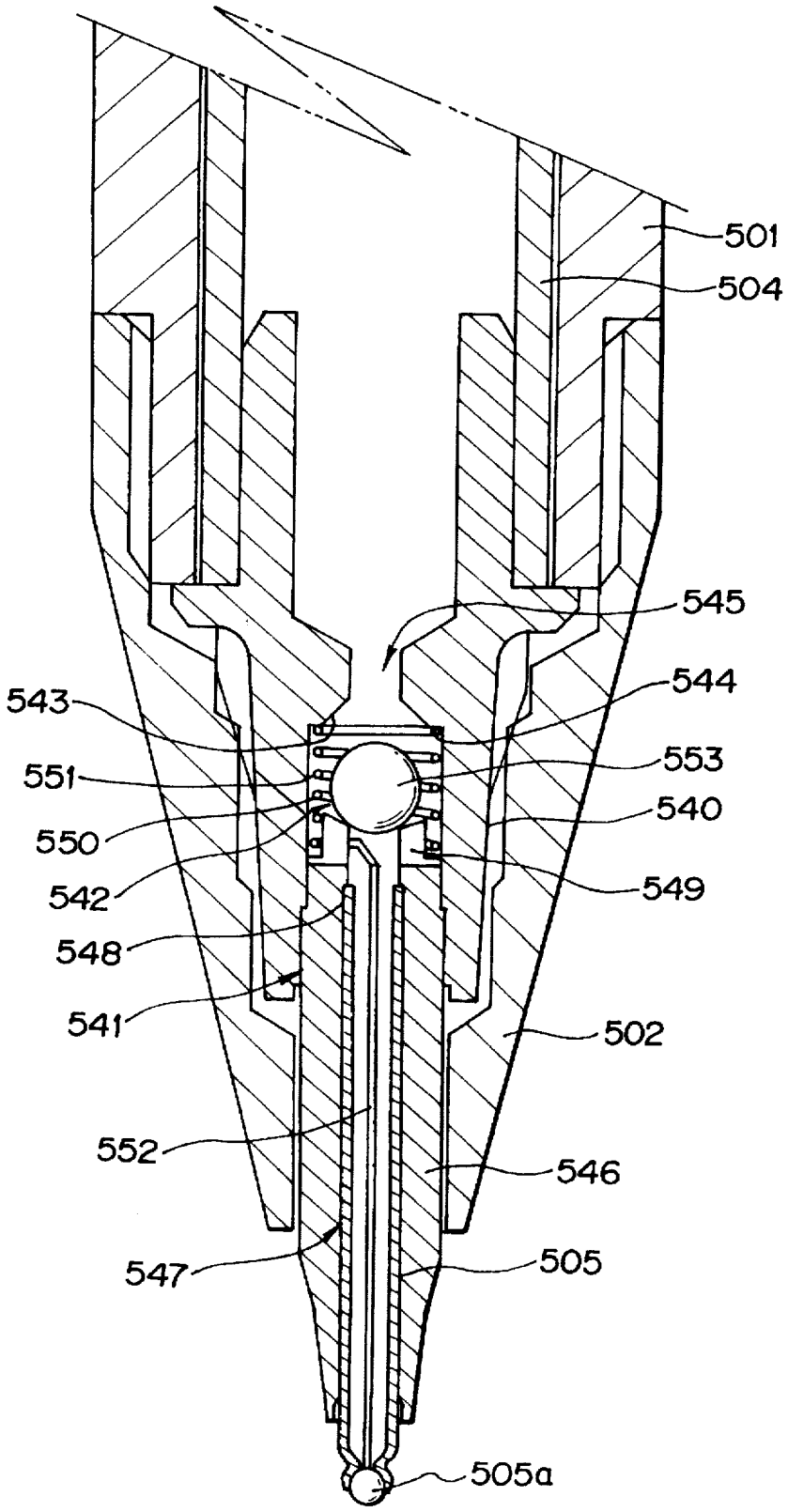
FIG. 15 is a longitudinal sectional view of the main part of a ball-point pen according to Example 11, which is set with its tip being directed downward.

FIG. 15 shows Example 11. In Example 11, a spring is interposed in a ball-point pen identical to that of Example 10.

A spring 550 consists of an upright straight portion 552 at its front portion and a coil portion 551 at its rear portion. The straight portion 552 is inserted in the inner hole of a tip 505, and the coil portion 551 is located around ribs 549 at the rear end of a holder 546.

A coupling 540 is integrally molded from an elastically deformable synthetic resin. A valve chamber 542 is formed in the rear portion of the coupling 540 to lead to a holder fitting hole 541.

A stepped portion 544 is formed behind the valve chamber 542, a tapered or spherical ball seat 543 is formed at the rear end of the valve chamber 542 and a stepped portion 544 is formed on the front edge of the ball seat, and a guide hole 545 is formed to extend from the center of the ball seat 543 to the rear end. A ball valve 553 is inserted inside the coil portion 551, and the holder 546 is fixed in the holder fitting hole 541 of the coupling 540.

The arrangements and actions of the ball-point pens according to the present invention have been described above. In the fine-pointed ball-point pen whose writing point ball has a diameter of 0.3 or 0.4 mm, the guide hole is hermetically closed with the ball valve loosely fitted in the valve chamber, and the writing point ball is brought into tight contact with the inner edge of the ball-holding portion of the tip with the rear surface pressed with the distal end of the spring, so that a back flow of the ink caused by upright writing or an impact can be prevented, thereby preventing contamination of the interior of the barrel or the user's hand or cloths. After upright writing or application of an impact, the ink starts to flow immediately, so that scratchy writing can be prevented.

In the ball-point pen of each of the above examples, as a tip and a mouthpiece are coupled to each other through a coupling, they do not cause a backlash, thereby providing comfortable writing.

What is claimed is:

1. A ball-point pen comprising:

a coupling having a distal end and a proximal end;

a tip coupled to said distal end of said coupling;

a reservoir tube coupled to said proximal end of said coupling;

a tip holder integrally formed on said distal end of said coupling, said tip holder having a tip fitting hole in which said tip is mounted;

a bushing having a guide hole therethrough; and a ball valve;

wherein:

a valve chamber is formed in a rear portion of said coupling;

said bushing is fixed within said coupling to form a ball seat on a rear portion of said valve chamber;

a plurality of projecting ridges with grooves therebetween are formed on a circumferential wall of a front portion of said valve chamber; and said ball valve is loosely fitted in said valve chamber so that when said ball-point pen is positioned with said tip directed upward, said ball valve is brought into tight contact with said ball seat to hermetically close said guide hole, and when said ball-point pen is positioned with said tip directed downward, said guide hole is opened, said ball valve is brought into contact with rear ends of said projecting ridges, and ink flows into said tip through said guide hole, said valve chamber, and said grooves formed between said ribs.

2. A ball-point pen according to claim 1, wherein:

said valve chamber is formed at said axial center of said coupling; and a spring is interposed in an inner hole of said tip such that a rear end portion thereof is in contact with a front end of said bushing and a distal end of said spring presses against a rear surface of a writing point ball rotatably held at a distal end portion of said tip so that said writing point ball is brought into tight contact with an inner edge of a ball holding portion of said tip.

3. A ball-point pen according to claim 2, wherein:

an upright straight portion is formed at a front portion of said spring;

a coil portion is formed at a rear portion of said spring;

said straight portion is inserted and fitted in said inner hole of said tip and against said writing point ball;

said coil portion is located at a rear end of said tip; and a rear end of said coil portion is in contact with a front end of said bushing.

4. A ball-point pen comprising:

a coupling having a distal end and a proximal end;

a small-diameter tip coupled to said distal end of said coupling;

a reservoir tube coupled to said proximal end of said coupling;

a tip holder mounted on said distal end of said coupling, said tip holder having a tip fitting hole in which said tip is fitted; and a ball valve;

wherein:

a valve chamber is formed at an axial center in a rear portion of said coupling:

a tapered or spherical ball seat is formed on a rear portion of said valve chamber, said ball seat having a guide hole formed therethrough;

a plurality of ribs with grooves therebetween are provided on a rear end of said tip holder and are located at a front end of said valve chamber such that upon removal of said tip holder said front end of said valve chamber is opened to permit insertion of said ball valve; and said ball valve is loosely fitted in said valve chamber when said tip holder is mounted on said distal end of said coupling such that when said ball-point pen is positioned with said tip directed upward, said ball valve is brought into tight contact with said ball seat to hermetically close said guide hole, and when said ball-point pen is positioned with said tip directed downward, said guide hole is opened and said ball valve is brought into contact with rear ends of said ribs, so that ink flows into said tip through said guide hole, said valve chamber, and said grooves formed between said ribs.

5. A ball-point pen according to claim 4, wherein:

said rear end of said valve chamber has a stepped portion;

a spring is forced forward in said valve chamber such that a rear end portion of said spring is in contact with said stepped portion on the rear end of said valve chamber; and a distal end of said spring extends through said tip and presses a rear surface of a writing point ball rotatably held at a distal end portion of said tip so that said writing point ball is brought into tight contact with an inner edge of a ball holding portion of said tip.

6. A ball-point pen according to claim 5, wherein:

an upright straight portion is formed at a distal end of said spring;

a coil portion is formed at a proximal end of said spring;

said straight portion is inserted and fitted in an inner hole of said tip;

said coil portion is inserted and fitted in said valve chamber;

a rear end of said coil portion is brought into contact with said stepped portion on the rear end of said valve chamber so that said straight portion presses a rear surface of said writing point ball; and said ball valve is loosely fitted in an inner space portion of said coil portion.

7. A ball-point pen according to claim 4, further comprising an inner shaft portion coupled between said distal end of said coupling and said rear end of said tip holder, said plurality of ribs being formed on a rear end of said inner shaft portion.

8. A ball-point pen comprising:

a coupling having a distal end with an inner shaft portion and a proximal end with a guide hole formed therethrough;

a tip coupled to said distal end of said coupling;

a reservoir tube coupled to said proximal end of said coupling;

a tip holder mounted on said inner shaft portion of said coupling, said tip holder having a tip fitting hole in which said tip is held; and a ball valve;

wherein:

a valve chamber is formed at an axial center in a rear portion of said coupling;

a tapered or spherical ball seat is formed on a rear portion of said valve chamber;

said tip is fixed at an axial center of said holder by said inner shaft portion of said coupling;

a plurality of ribs with grooves therebetween are formed at a rear end of said inner shaft portion and are located at a front end of said valve chamber; and said ball valve is loosely fitted in said valve chamber so that when said ball-point pen is positioned with said tip directed upward, said ball valve is brought into tight contact with said ball seat to hermetically close said guide hole, and when said ball-point pen is positioned with said tip directed downward, said guide hole is opened, said ball valve is brought into contact with rear ends of said ribs, and ink flows into said tip through said guide hole, said valve chamber, and said grooves formed between said ribs.

9. A ball-point pen according to claim 8, wherein:

said rear end of said valve chamber has a stepped portion;

a spring is interposed in said valve chamber to extend forward such that a rear end portion thereof is in contact with said stepped portion at the rear end of said valve chamber; and a distal end of said spring extends through said tip and presses against a rear surface of a writing point ball rotatably held at a distal end portion of said tip so that said writing point ball is brought into tight contact with an inner edge of a ball holding portion of said tip.

10. A ball-point pen according to claim 9, wherein:

an upright straight portion is formed at a distal end of said spring;

a coil portion is formed at a proximal end of said spring;

said straight portion is inserted and fitted in an inner hole of said tip;

said coil portion is inserted and fitted in said valve chamber;

a rear end of said coil portion is brought into contact with said stepped portion on the rear end of said valve chamber so that said straight portion presses a rear surface of said writing point ball; and said ball valve is loosely fitted in an inner space portion of said coil portion.

11. A ball-point pen comprising:

a coupling having a distal end with a shaft portion and a proximal end;

a tip coupled to said distal end of said coupling;

a reservoir tube coupled to said proximal end of said coupling;

a tip holder mounted on said shaft portion of said coupling, said tip holder having a tip fitting hole in which said tip is held;

a bushing having a guide hole therethrough; and a ball valve;

wherein:

a valve chamber is formed in said coupling;

said bushing is fixed within said coupling to form a ball seat on a rear portion of said valve chamber;

a plurality of projecting ridges with grooves therebetween are formed on a circumferential wall of a front portion of said valve chamber; and said ball valve is loosely fitted in said valve chamber so that when said ball-point pen is positioned with said tip directed upward, said ball valve is brought into tight contact with said ball seat to hermetically close said guide hole, and when said ball-point pen is positioned with said tip directed downward, said guide hole is opened, said ball valve is brought into contact with rear ends of said projecting ridges, and ink flows into said tip through said guide hole, said valve chamber, and said grooves formed between said projecting ridges.

12. A ball-point pen according to claim 11, wherein a low-viscosity ink or an ink having shear thinning properties and a statically high viscosity that is decreased upon rotation of a writing point ball during writing so that the ink flows out, is filled in said reservoir tube, and a follower that follows exhaustion of said ink is provided at a rear end of said ink.

13. A ball-point pen according to claim 11, wherein a separate reservoir tube is mounted on a rear end of said coupling.

* * * * *